US011761125B2

(12) United States Patent
Babinchak et al.

(10) Patent No.: US 11,761,125 B2
(45) Date of Patent: Sep. 19, 2023

(54) WEAR AND PERFORMANCE SLING WITH HYBRID MATERIAL WEBBIING

(71) Applicant: Lift-All Company, Inc., Landisville, PA (US)

(72) Inventors: Gregory S. Babinchak, Elizabethtown, PA (US); Steven Pacilio, Landisville, PA (US)

(73) Assignee: Lift-All Company, Inc., Landisville, PA (US)

( * ) Notice: Subject to any disclaimer, the term of this patent is extended or adjusted under 35 U.S.C. 154(b) by 0 days.

(21) Appl. No.: 18/085,793

(22) Filed: Dec. 21, 2022

(65) Prior Publication Data

US 2023/0235491 A1 Jul. 27, 2023

Related U.S. Application Data

(60) Provisional application No. 63/301,694, filed on Jan. 21, 2022.

(51) Int. Cl.
*D03D 3/00* (2006.01)
*D03D 15/283* (2021.01)
(Continued)

(52) U.S. Cl.
CPC ..... *D03D 3/005* (2013.01); *D03D 11/00* (2013.01); *D03D 15/283* (2021.01); *D03D 15/50* (2021.01); *D07B 1/04* (2013.01); *D10B 2331/02* (2013.01); *D10B 2331/04* (2013.01); *D10B 2505/00* (2013.01)

(58) Field of Classification Search
CPC ..... D03D 3/005; D03D 11/00; D03D 15/283; D03D 15/50; D07B 1/04; D10B 2331/02; D10B 2331/04; D10B 2505/00
See application file for complete search history.

(56) References Cited

U.S. PATENT DOCUMENTS 4,052,095 A * 10/1977 Johnson ..... B66C 1/18 294/74
4,174,738 A * 11/1979 Berger ..... D03D 1/0005 139/432

(Continued)

FOREIGN PATENT DOCUMENTS

CN 105246361 * 1/2016
EP 0261415 A2 * 3/1988
KR 101757807 B1 * 7/2017

OTHER PUBLICATIONS schrothracing.com, Oct. 29, 2020 (https://www.schrothracing.com/post/the-advantages-of-polyester-webbing#:~: text=Nylon%20webbing%20has%20a%20elongation,18%25%20depending%20on%20the%20application) and (Year: 2020) https://web.archive.org/web/20201029230008/https://www.schrothracing.com/post/the-advantages-of-polyester-webbing (Year: 2020).*

*Primary Examiner* — Stephen A Vu
(74) *Attorney, Agent, or Firm* — Potomac Law Group, PLLC

(57) ABSTRACT

A webbing for use with a tiedown or sling which has overall increase strength efficiency when compared to known tie-downs or slings which use texturized yarn. The webbing contains non-texturized yarn material having reduced elongation characteristics in the core, combined with non-texturized yarn having higher elongation and improved wear characteristics on the exterior surfaces.

20 Claims, 2 Drawing Sheets

(51) Int. Cl.

| | |
|---|---|
| ***D03D 15/50*** | (2021.01) |
| ***D03D 11/00*** | (2006.01) |
| ***D07B 1/04*** | (2006.01) |

(56) References Cited

U.S. PATENT DOCUMENTS

| | | | | |
|---|---|---|---|---|
| 4,856,837 | A * | 8/1989 | Hammersla, Jr. | B66C 1/18 139/411 |
| 5,436,044 | A * | 7/1995 | Pinkos | D03D 11/02 139/411 |
| 6,283,167 | B1 * | 9/2001 | Chang | D03D 11/00 139/383 R |

* cited by examiner

WEAR AND PERFORMANCE SLING WITH HYBRID MATERIAL WEBBIING

FIELD OF THE INVENTION

The present invention is directed a webbing, tiedown or sling for lifting, restraint or other material handling functions with improved retained strength and durability. In particular, the invention is directed to webbing that contains non-texturized yarn material having reduced elongation characteristics in the core, combined with non-texturized yarn having higher elongation and improved wear characteristics on the exterior surfaces of the cover.

BACKGROUND OF THE INVENTION

Woven webbings have long been used as tiedowns and/or slings for securing, lashing or lifting various objects. When such tiedowns or slings are used in various environments, the outside surfaces of the tiedowns or slings often come into contact with rough surfaced objects which can abrade and/or cut into the webbing, causing the strap to cut, tear or break. In addition, the outside surfaces are moved or slide over surfaces, causing friction and abrasion of the outside surface. In order to improve the wear characteristics, known tiedowns and/or slings use texturized yarn. However, the use of such texturized yarn increases the frictional resistance and decreases the strength efficiency of the tiedowns and/or slings.

Narrow fabric webbing has historically been constructed with each webbing using a single homogeneous type of material. Improvements in the durability along the selvages of narrow fabrics has been achieved through the implementation of positioning materials possessing improved abrasion and cutting performance along the edges of webbing. Also, improvements in general durability have been achieved through the adoption of using texturized yarn. With heavy forms of narrow fabric/webbing used in the production of cargo tiedowns and lifting slings, the texturized yarn is commonly positioned predominantly on the exterior surfaces that are exposed to the most aggressive damage caused by abrasion and cutting. However, a drawback of using texturized yarn is that this yarn elevates frictional resistance and surface temperatures at web or web choke contact areas and contributes very little to the strength of the webbing.

It would, therefore, be beneficial to provide a tiedown or sling for lifting, restraint or other material handling functions that have elevated retained strength and improve wear characteristics. It would be particularly beneficial to have a tiedown or sling with webbing the contains non-texturized yarn material having reduced elongation characteristics in the core, combined with non-texturized yarn having higher elongation and improved wear characteristics on the exterior surfaces of the cover.

SUMMARY OF THE INVENTION

An object of the invention is to provide a webbing for a tiedown or sling which has overall increased strength and wear efficiency when compared to known tiedowns or slings which use texturized yarn to improve wear characteristics.

An object of the present invention is to provide a webbing which combines predominantly two types of non-texturized yarn for maximum durability without using texturized yarn. One type of non-texturized yarn with good abrasion and frictional properties is positioned predominantly on the primary exterior covering surfaces. To further enhance the durability of the webbing, a second type of non-texturized yarn with reduced elongation properties is positioned predominantly within the core areas of the webbing. The use of two types of non-texturized yarn is beneficial during operations because in a majority of cargo securement and lifting applications much of the webbing damage occurs during the tensioning and load release cycles due to movement and interaction of the webbing against load surfaces, and against webbing surfaces along choke contact areas when slings are used in a choker hitch. Using lower elongation materials will serve to reduce the amount of movement occurring during these phases of operation.

An object of the present invention is to provide a webbing which improves the performance of the sling at the choke point by reducing friction compared to texturized yarn. As less friction is generated, less abrasion and heat is generated at the area where the choking surfaces of the webbing meet, thereby preventing fusing or melting of the choke surfaces.

An embodiment is directed to a webbing type tiedown or sling. The webbing construction includes two primary exterior cover surfaces and a core. The two primary exterior cover surfaces have synthetic, continuous filament yarn material with good wear characteristics that is predominantly non-texturized. The core predominantly has a different yarn material with lower elongation than that used along the cover surfaces of the webbing.

An embodiment is directed to a tiedown or sling with webbing that contains yarn material having reduced elongation characteristics in the core, combined with predominantly non-texturized yarn material having higher elongation and improved wear characteristics on the exterior surfaces of the cover.

An embodiment is directed to a webbing the contains predominantly non-texturized yarn material having reduced elongation characteristics in the core, combined with predominantly non-texturized yarn having higher elongation and improved wear characteristics on the exterior surfaces of the cover.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
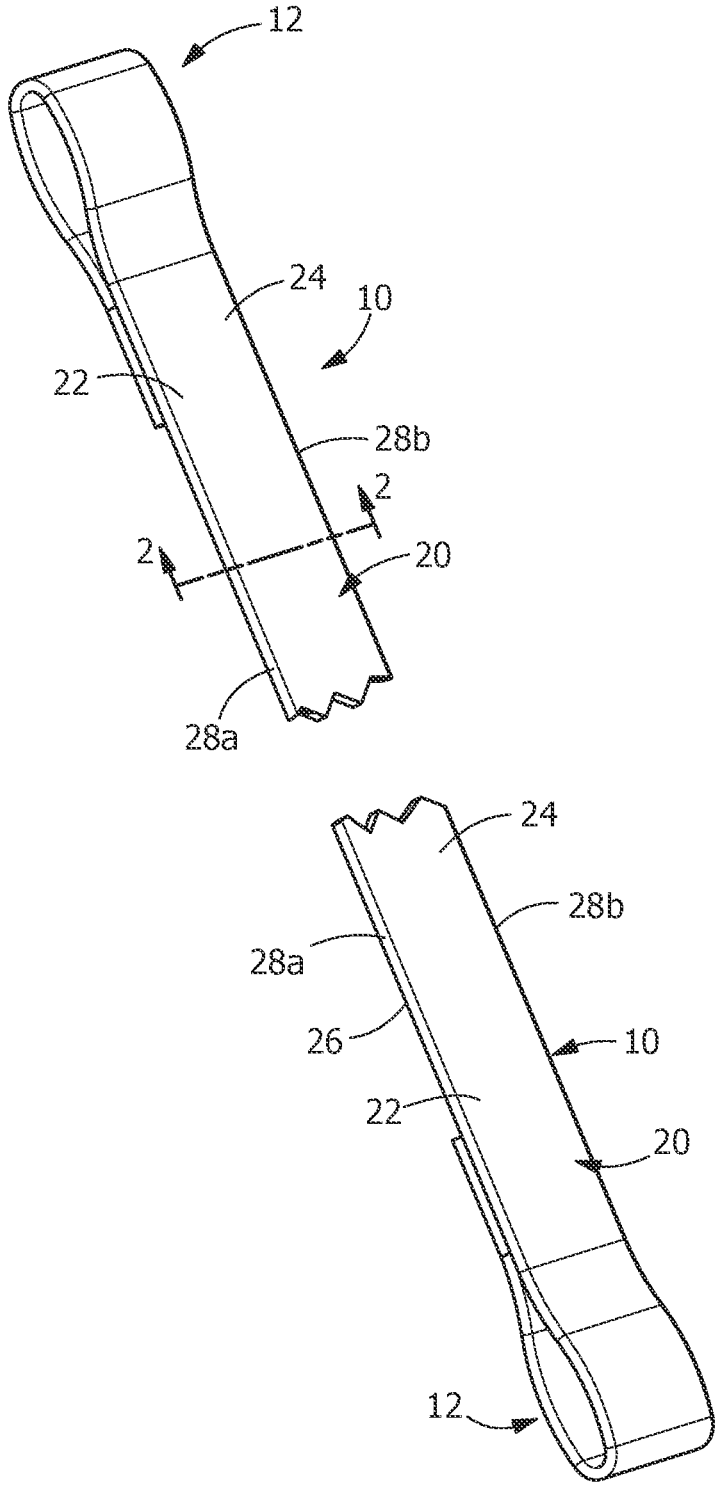
FIG. 1 is a perspective view of an illustrative embodiment of a sling of the present invention, the sling having cut resistant edge portions.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

As shown in FIG. 1, an illustrative tiedown or sling 10, for lifting, restraint or other material handling functions, includes, soft eyes 12 and either end. While the eyes 12 are shown at either end, other embodiments of the tiedown or sling 10 may be used without departing from the scope of the invention. For example, the tiedown or sling 10 may be an endless sling. The tiedown or sling 10 may be used to lift or lash an object or may be used as a component of a device which used for lifting or lashing.

Figure 2:
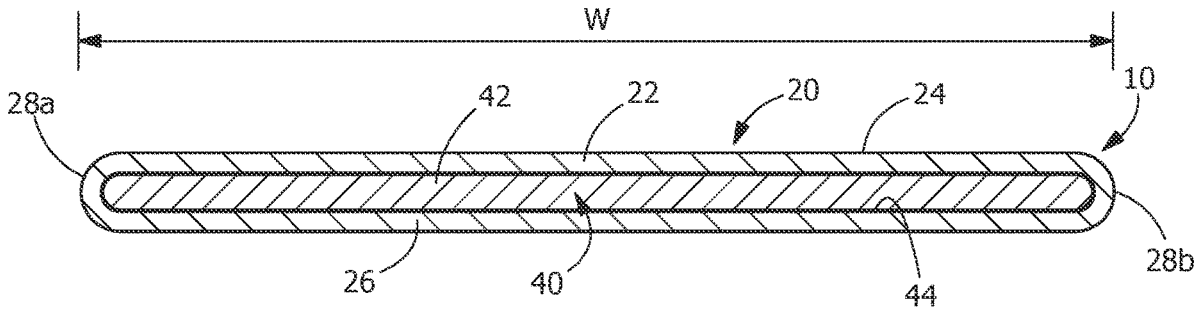
FIG. 2 is a cross-sectional view of the of the sling taken along line 2-2 of FIG. 1.

As shown in illustrative embodiment of FIG. 2, the tiedown or sling 10 has a core or inside member 40 and a cover, sleeve or outside member 20. The cover 20 may be made of one or more layers or plies of woven webbing material 22. The warp of the woven webbing material 22 includes a non-texturized first yarn, such as, but not limited to nylon. The warp of the woven webbing material 22 includes, but is not limited to, predominately or at least approximately 50% of non-texturized yarn, at least approximately 60% of non-texturized yarn, at least approximately 75% of non-texturized yarn, at least approximately 90% of non-texturized yarn. The weft of the woven webbing material 22 may be the same non-texturized yarn or other material or a combination thereof.

The cover 20 has a first or top surface 24, an oppositely facing second or bottom surface 26 and edge surfaces 28 which extend between the top surface 24 and the bottom surface 26. The edge surfaces 28 include a first edge surface 28*a* and an oppositely facing second edge surface 28*b*. The first edge surface 28*a* and the second edge surface 28*b* extend essentially parallel to each other. A width W of the cover 20 extends from the first edge surface 28*a* to the second edge surface 28*b*. The top surface 24, bottom surface 26 and edge surfaces 28 surround and enclose the core 40. The top surface 24 and the bottom surface 26 are the two primary exterior surfaces of the cover 20.

In alternate embodiments, the edges of the cover 20, which include the edge surfaces 28, may be cut resistant, hollow edges as shown and described in U.S. Pat. No. 11,021,346, which is incorporated herein by reference in its entirety.

The webbing material 22 of the two primary exterior surfaces 24, 26 of the cover 20 has improved wear characteristics, including good abrasion and frictional properties, and higher elongation when compared to the core 40 or to texturized yarns. In various illustrative examples, the percent elongation of the of the yarn of the webbing material 22 is at least 10% more than that of the material used in the core 40.

The webbing material 22 of the two primary exterior surfaces 24, 26 of the cover 20 afford protection to the core 40 against abrading or cutting at any point along the length of the tiedown or sling 10. An illustrative embodiment of the cover 20 and the webbing material 22 is shown in the figures. However, other configurations of the cover 20 and the webbing material 22 may be used without departing from the scope of the invention.

The webbing material 22 of the cover 20 may include one or more plies. In one illustrative embodiment, the plies may be formed of warp yarns continuously woven with weft yarns, which are bound together by binder yarns.

The core 40 may be made of one or more layers or plies of woven webbing material 42. The woven webbing material 42 includes a non-texturized second yarn, such as, but not limited to polyester or Dyneema. The woven webbing material 42 includes, but is not limited to, predominately or at least approximately 50% of non-texturized yarn, at least approximately 60% of non-texturized yarn, at least approximately 75% of non-texturized yarn, at least approximately 90% of non-texturized yarn. While in the illustrative embodiment different materials, such as nylon and polyester are used for the cover and the core, other embodiments may use similar materials, such as all polyester or all nylon, for the cover and the core. However, where similar materials are used, the yarn material of the core and the yarn material of the cover would be configured to have different characteristics, such as different percent elongation during tensioning.

The core 40 is retained in the cavity or opening 44 provided between the top surface 24, bottom surface 26 and edge surfaces 28 of the cover 20. The core 40 is enclosed by the top surface 24, bottom surface 26 and edge surfaces 28 of the cover 20. The width and thickness of the core 40 can be varied according to the desired characteristics, such as, but not limited to, elongation, strength, required for the particular application.

The webbing material 42 of the core 40 has elongation characteristics which prevent or minimize undesired stretching or elongation of the core 40 when the core 40 is exposed to loads. In various illustrative examples, the percent elongation of the webbing material 42 is approximately 10%, between approximately 12% and approximately 16%, less than approximately 15%.

In every embodiment, the percent elongation of the webbing material 42 of the core 40 is less than the percent elongation of the webbing material 22 of the cover 20. For example, the elongation of the webbing material 22 of the cover at break may be approximately 25% larger than the elongation of the webbing material 42 of the core 40, the elongation of the webbing material 22 of the cover at break may be approximately 10% larger or more than the elongation of the webbing material 42 of the core 40.

The webbing material 42 of the core 40 provides the strength needed to lift a respective load. The illustrative embodiment in the figures show one illustrative configuration of the core 40. However, other configurations of the core 40 may be used without departing from the scope of the invention.

As the webbing material 22 of the cover 20 is configured to have good abrasion and frictional properties, the webbing material 22 of the cover 20 can engage the hook or other device of the lifting mechanism or the load to be lifted with minimal damage. The increased elongation of the webbing material 22 of the cover 20 allows the webbing material 22 of the cover 20 to move relative to the any choke point, while the good abrasion and frictional properties provide improved wear characteristics between the outside surface of the webbing material 22 of the cover 20 and the hook or other device of the lifting mechanism or the load to be lifted.

While providing improved wear characteristics, the non-texturized yarn of the webbing material 22 of the cover 20 provides less movement, and less scrubbing, relative the hook or other device of the lifting mechanism or the load to be lifted than known texturized yarn, thereby allowing the current invention to be used over many cycles without failure. In a majority of cargo securement and lifting applications much of the webbing damage occurs during the tensioning and load release cycles due to movement and interaction of the webbing against load surfaces, therefore, using lower elongation materials in the cover 20 and the core 40 will serve to reduce the amount of movement occurring during these phases of operation.

As the webbing material 22 of the cover 20 and the webbing material 42 of the core 40 have non-texturized yarn, the friction between the webbing material 22 and the webbing material 42 is reduced compared to the friction that occurs between texturized materials. Consequently, as the webbing material 22 of the cover 20 is moved or elongated at a different rate than the webbing material 42 of the core 40, the reduced friction results in less heat being generated between the webbing material 22 and the webbing material 42. This is particularly significant at the choke point, which experiences the most significant forces from the load. As less heat is generated, melting or fusing of the webbing material 22 and the webbing material 42 is reduced or eliminated. This allows the tiedown or sling 10 to be to be used over many cycles without failure.

The friction between the webbing material 22 and the webbing material 42 and the friction at the choke point between the webbing material 22 and the hook or other device of the lifting mechanism or the load to be lifted can be further reduced by applying a high lubricity coating to the webbing material 22, the webbing material 42 or both.

As the webbing material 22 of the cover 20 encapsulates and protects the webbing material 42 of the core 40, the webbing material 42 of the core 40 does not need to have the same abrasion and friction requirement as the webbing material 22 of the cover 20. Therefore, the webbing material 42 of the core 40, and in particular the elongation characteristics of the webbing material 42 of the core 40, can be maximized with little regard to the wear characteristics. As the webbing material 42 of the core 40 has less elongation during tensioning than the webbing material 22 of the cover 20, the webbing material 42 of the core 40 can be chosen to provide the strength characteristics required for the particular application. In particular, as the webbing material 42 of the core 40 is made from non-texturized yarn and the webbing material 22 of the cover 20 is made from non-texturized yarn, the scrubbing and friction between the webbing material 42 of the core 40 and the webbing material 22 of the cover 20 is minimized, preventing or minimizing wear on the webbing material 42 of the core 40.

As the webbing material 42 of the core 40 and the webbing material 22 of the cover 20 are made from different non-texturized yarns, the webbing materials 22, 42 have different characteristics and properties. One such difference is the appearance of the materials 22, 42. Another difference is the dyeability of the materials 22, 42. As the tiedown or sling 10 is exposed to a dying operation, the webbing material 42 of the core 40 will absorb the dye at different levels that the webbing material 22 of the cover 20. Consequently, the appearance or color of the webbing material 42 of the core 40 will be different than the webbing material 22 of the cover 20.

As the appearance or color of the webbing material 42 of the core 40 is different than the webbing material 22 of the cover 20, if the webbing material 22 of the cover 20 is compromised, the webbing material 42 of the core 40 or added safety marker yarn within can offer improved visibility to the user. As the webbing material 42 of the core 40 will be visible upon failure of the webbing material 22 of the cover 20, the visibility of the webbing material 42 of the core 40 can be used as an out of surface marker. The visible out of service marker serves a tool for indicating when the amount of damage to the webbing material 22 of the cover 20 has penetrated to a level such that the tiedown or sling 10 needs to be taken out of service.

In alternate embodiments, the tie down or sling 12 may include an out of service marker as shown and described in U.S. Pat. No. 10,494,042, which is incorporated herein by reference in its entirety. The out of service marker may be used in place of or in conjunction with the out of service marker described in the preceding paragraph.

As the webbing material 42 of the core 40 and the webbing material 22 of the cover 20 are made from different non-texturized yarns, the sling 10 has improved reserve strength when exposed to an acid or a caustic. For example, if the sling 10 is exposed to an acid, the nylon webbing material 22 in the cover 20 will degrade, while the polyester webbing material 42 of the core 40 will have less degradation, allowing the sling 10 to retain a higher amount of reserve strength and not fail. Alternatively, if the sling 10 is exposed to a caustic, the polyester webbing material 42 of the core 40 will degrade, while the nylon webbing material 22 in the cover 20 will have less degradation, allowing the sling 10 to retain adequate reserve strength to prevent a complete failure of a webbing product.

An embodiment of the tiedown or sling contains webbing material in the core that predominately contains non-texturized yarn material, such as polyester, having reduced elongation characteristics (less than 20% elongation at break), combined with predominately non-texturized yarn material, such as nylon, in the cover. The non-texturized yarn material of the cover has both higher elongation and improved wear characteristics on a two primary exterior services of the cover. This results in a tiedown or sling which has: improved wear characteristics; elevated retained strength efficiency whenever the webbing material of the core is formed around an edge during sling operation; reduced abrasion and heat buildup on surfaces of the webbing material of the cove where webbing on webbing scrubbing occurs, such as along sling choking surfaces; and excellent strength efficiency overall when compared against other current, alternative designs of tiedowns or slings that use texturized yarn to improve wear characteristics.

The sling and webbing of the present invention combines predominantly two types of non-texturized yarn for maximum durability without using texturized yarn. One type of non-texturized yarn with good abrasion and frictional properties is positioned predominantly on the exterior covering surfaces. To further enhance the durability of the webbing, a second type of non-texturized yarn with reduced elongation properties is positioned predominantly within the core areas of the webbing. The use of two types of non-texturized yarn is beneficial during operations because in a majority of cargo securement and lifting applications much of the webbing damage occurs during the tensioning and load release cycles due to movement and interaction of the webbing against load surfaces. Using lower elongation materials will serve to reduce the amount of movement occurring during these phases of operation.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A webbing tiedown or sling comprising:

a woven webbing comprising:

two primary exterior surfaces uniformly bound together through a central core;

the core having synthetic, first thermoplastic yarn material wherein at least 75% of the first thermoplastic yarn material is non-texturized and continuous filament;

the two primary exterior cover surfaces having second thermoplastic yarn material wherein at least 50% of warp of the second thermoplastic yarn material is non-texturized and continuous filament;

the warp of the second thermoplastic, non-textured yarn material of the two cover surfaces having good abrasion characteristics and also having higher elongation characteristics during tensioning than the first thermoplastic, non-textured yarn material, yielding an approximately 10% or higher elongation during tensioning than that of said first thermoplastic, non-textured yarn material.

2. The webbing tiedown or sling as recited in claim 1, wherein the first thermoplastic yarn material in the core is polyester.

3. The webbing tiedown or sling as recited in claim 1, wherein the second thermoplastic, non-textured yarn material in the cover surfaces is nylon.

4. The webbing tiedown or sling as recited in claim 1, wherein an appearance of the first thermoplastic yarn material in the core is different than an appearance of the second thermoplastic yarn material of the cover surfaces, wherein if the second thermoplastic yarn material of the cover surfaces is compromised, the appearance of the first thermoplastic yarn material in the core is used as an out of surface marker.

5. The webbing tiedown or sling as recited in claim 1, wherein at least 50% of the first thermoplastic yarn material is non-texturized and at least 50% of the second thermoplastic yarn material is non-texturized, friction between the first thermoplastic yarn material and the second thermoplastic yarn material is reduced compared to the friction that occurs between texturized materials, wherein as the second thermoplastic yarn material is moved or elongated at a different rate than the first thermoplastic yarn material, the reduced friction results in less heat being generated between the second thermoplastic yarn material and the first thermoplastic yarn material.

6. The webbing tiedown or sling as recited in claim 1, wherein high lubricity coating is applied to the first thermoplastic yarn material, the second thermoplastic yarn material, or both.

7. A tiedown or sling comprising:

a woven webbing comprising;

a core having core material having reduced elongation characteristics in the core; and a cover having cover material which is predominantly non-texturized having higher elongation than the core material and improved wear characteristics;

wherein at least 50% of the core material is non-texturized and at least 50% of the cover material is non-texturized, friction between the core material and the cover material is reduced compared to the friction that occurs between texturized materials, wherein as the cover material is moved or elongated at a different rate than the core material, the reduced friction results in less heat being generated between the cover material and the core material.

8. The tiedown or sling as recited in claim 7, wherein the core material is predominantly non-texturized yarn material.

9. The tiedown or sling as recited in claim 7, wherein the core material is polyester yarn.

10. The tiedown or sling as recited in claim 9, wherein the cover material is nylon yarn.

11. The tiedown or sling as recited in claim 7, wherein the core is enclosed and retained in an opening of the cover, the opening is provided between a top surface, a bottom surface and edge surfaces of the cover.

12. The tiedown or sling as recited in claim 7, wherein the core material is woven yarn material.

13. The tiedown or sling as recited in claim 12, wherein the cover material is woven yarn material.

14. The tiedown or sling as recited in claim 7, wherein an appearance of the core material is different than an appearance of the cover material, wherein if the cover material is compromised, the appearance of the core material is used as an out of surface marker.

15. A woven webbing comprising:

predominantly a first non-texturized yarn material having reduced elongation characteristics in a core of the webbing; and predominantly a second non-texturized yarn having higher elongation and improved wear characteristics on an exterior surface of the webbing;

wherein at least 50% of the first non-texturized yarn material is non-texturized and at least 50% of the second non-texturized yarn material is non-texturized, friction between the first non-texturized yarn material and the second non-texturized yarn material is reduced compared to the friction that occurs between texturized materials, wherein as the second non-texturized yarn material is moved or elongated at a different rate than the first non-texturized yarn material, the reduced friction results in less heat being generated between the second non-texturized yarn material and the first non-texturized yarn material.

16. The woven webbing as recited in claim 15, wherein the first non-texturized yarn material is woven yarn material.

17. The woven webbing as recited in claim 15, wherein the second non-texturized yarn is woven yarn material.

18. The woven webbing as recited in claim 15, wherein an appearance of the first non-texturized yarn material is different than an appearance of the second non-texturized yarn material, wherein if the first non-texturized yarn material is compromised, the appearance of the first non-texturized yarn material is used as an out of surface marker.

19. The woven webbing as recited in claim 15, wherein high lubricity coating is applied to the first non-texturized yarn material, the second non-texturized yarn material, or both.

20. The woven webbing as recited in claim 15, wherein during tensioning, the first non-texturized yarn material yielding an approximately 10% or higher elongation at break than the second non-texturized yarn material.

* * * * *